US005280907A

United States Patent [19]

Liu

[11] Patent Number: 5,280,907

[45] Date of Patent: Jan. 25, 1994

[54] PROTECTIVE CASING FOR A GAME RACKET

[76] Inventor: Leueis Liu, No. 8, Alley 23, Lane 684, Yuan Huan East Rd., Feng Yuan, Taichung Hsien, Taiwan

[21] Appl. No.: 966,554

[22] Filed: Oct. 26, 1992

[51] Int. Cl.[5] ..... A63B 49/14

[52] U.S. Cl. ..... 273/73 C

[58] Field of Search ..... 273/73 R, 73 C, 73 D, 273/73 A, 73 B, 73 F

[56] References Cited

U.S. PATENT DOCUMENTS

| | | | |
|---|---|---|---|
| 2,552,020 | 5/1951 | Tribelhorn | 273/73 C |
| 3,612,526 | 10/1971 | Brull | 273/73 C |
| 3,625,512 | 12/1971 | Latham | 273/73 C |
| 4,194,738 | 3/1980 | Inoue et al. | 273/73 C |
| 4,776,592 | 10/1988 | Umlauft et al. | 273/73 C X |
| 4,836,543 | 6/1989 | Holzer | 273/73 C |
| 4,858,928 | 8/1989 | Muroi et al. | 273/73 C X |
| 4,889,337 | 12/1989 | Todd | 273/73 C X |
| 5,102,132 | 4/1992 | Chen | 273/73 D X |

FOREIGN PATENT DOCUMENTS

| | | | |
|---|---|---|---|
| 211176 | 2/1924 | United Kingdom | 273/73 C |
| 627240 | 8/1949 | United Kingdom | 273/73 C |
| 2088220 | 6/1982 | United Kingdom | 273/73 C |

*Primary Examiner*—William Stoll

[57] ABSTRACT

A protective casing for use in a game racket has a plurality of hollow tubes and a main body comprising two protective plates. Each of the protective plates is provided thereon with a predetermined number of floating plates, each of which has an inner surface spaced at a predetermined distance from the outer wall of the racket frame, and each of which is provided peripherally with a connecting plate attached to the protective plate in a manner that there is a height differential between the floating plate and the protective plate.

4 Claims, 4 Drawing Sheets

PROTECTIVE CASING FOR A GAME RACKET

BACKGROUND OF THE INVENTION

The present invention relates to a protective casing which is for use in a game racket and provides an excellent cushion effect.

As shown in FIG. 1, a protective casing 1 of the prior art has a plurality of hollow tubes 11, which are connected on the same side thereof in a linear manner. Located at both sides of the main body of the protective casing 1 are protective plates 12. In using the protective casing 1 described above, the hollow tubes 11 are inserted into the string holes 21 of the game racket frame 2 while the protective plates 12 are fittingly attached to the outer walls of the racket frame 2. As a result, the racket frame 2, especially the top portion of the racket frame 2, is protected from damage at such time when the racket frame 2 hits the surface of the court accidentally. However, the protective plates 12 are often made intentionally as thin as possible in order that an increase in the overall weight of the game racket by the protective plates 12 is minimized. Such thin protective plates 12 are often quite ineffective in protecting the racket frame 2.

An improved protective casing of the prior art is shown in FIG. 2. Such protective casing is provided with a thicker protective plate 12 intended to enhance the overall cushion effect of the protective casing. However, such improved protective casing of the prior art is still ineffective for providing an adequate cushion effect to prevent the impact force from being transmitted to the racket frame 2.

SUMMARY OF THE INVENTION

It is therefore the primary objective of the present invention to provide a game racket with a protective casing having an excellent cushion effect.

In keeping with the principles of the present invention, the foregoing objective of the present invention is accomplished by a protective casing for a game racket, which casing has a plurality of hollow tubes spaced at an appropriate interval in a manner that they are parallel to one another. The hollow tubes are so arranged that their ends situated on the same side are attached to the main body of the protective casing which is composed of two protective plates attached respectively to both sides of the main body of the protective casing. Such protective casing of the present invention is mounted on the outer wall of a game racket in a manner that the hollow tubes of the protective casing are inserted into the string holes of the racket frame and that the protective plates are attached fittingly to the outer wall of the racket frame. The protective casing for a game racket of the present invention is characterized in that each of the protective plates is provided thereon with a predetermined number of floating plates, each of which plates has an inner surface situated at a predetermined distance from the outer wall of the racket frame. The floating plate is provided with a peripheral connecting plate, which is attached to the protective plate in a manner to provide a height differential between the floating plate and the protective plate.

The foregoing objective, structures, features and functions of the present invention will be better understood by studying the following detailed description of the present invention, in conjunction with the drawings provided herewith.

DETAILED DESCRIPTION OF THE PREFERRED EMBODIMENTS

Figure 1:
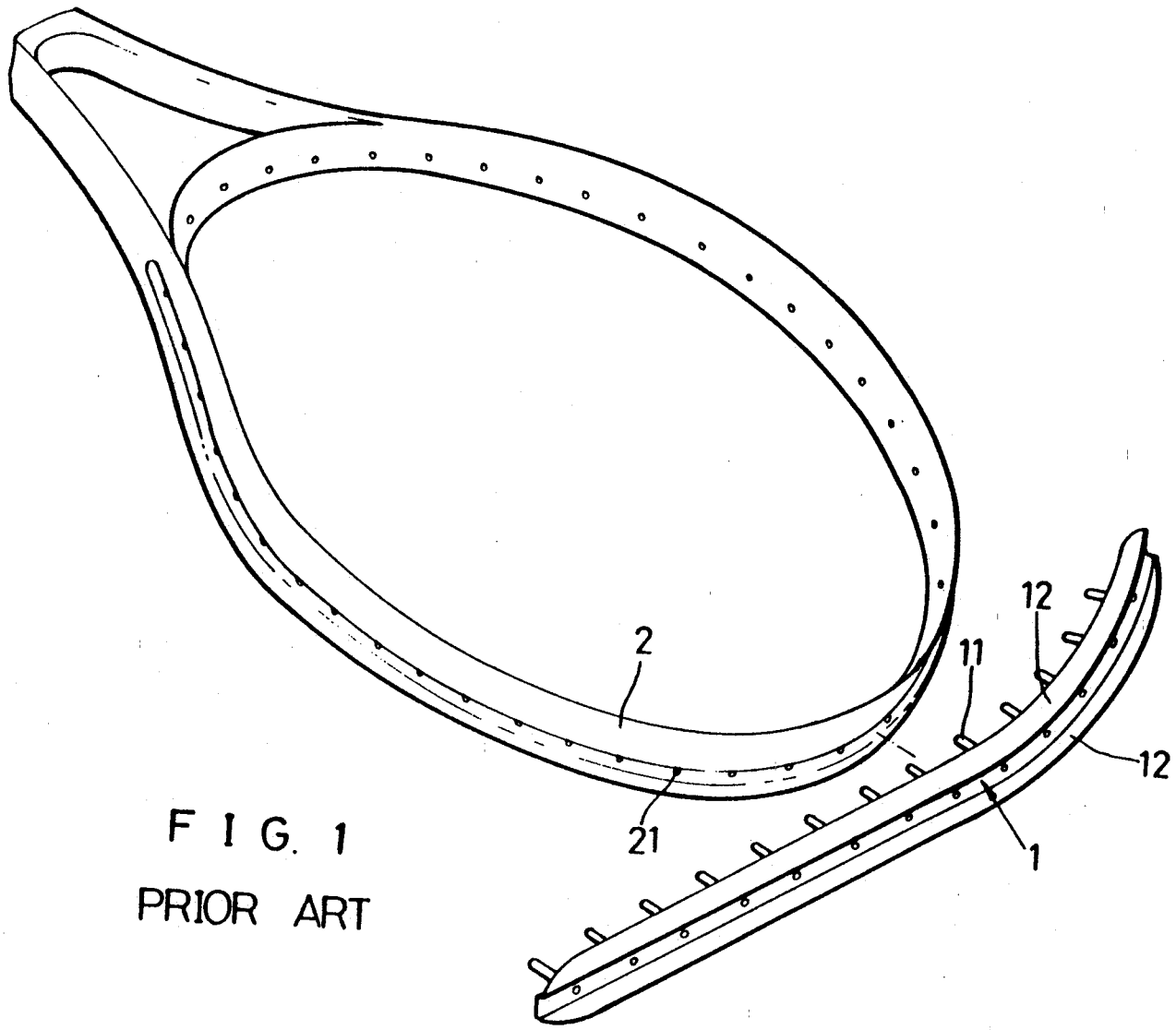
FIG. 1 PRIOR ART
FIG. 1 shows an external view of a prior art protective casing for a game racket.
Figure 2:
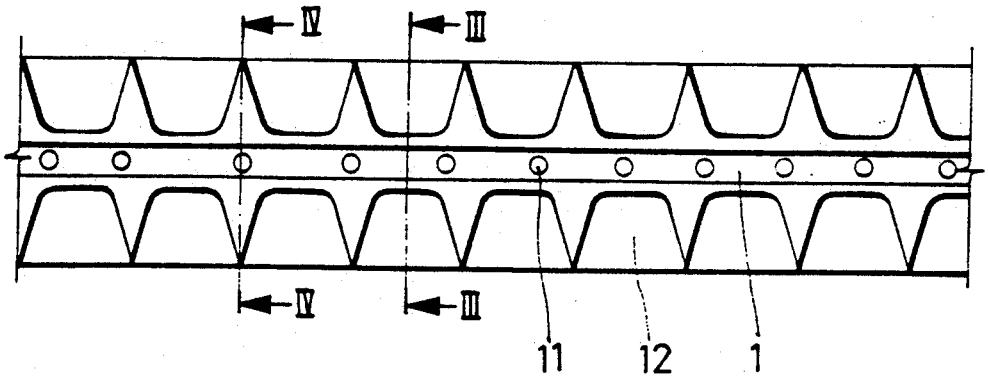
FIG. 2 PRIOR ART
FIG. 2 shows a plan view of another prior art protective casing for a game racket.
Figure 3:
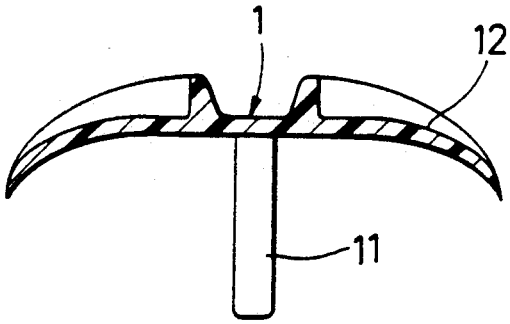
FIG. 3 PRIOR ART
FIG. 3 shows a sectional view of a portion taken along the line III—III as shown in FIG. 2.
Figure 4:
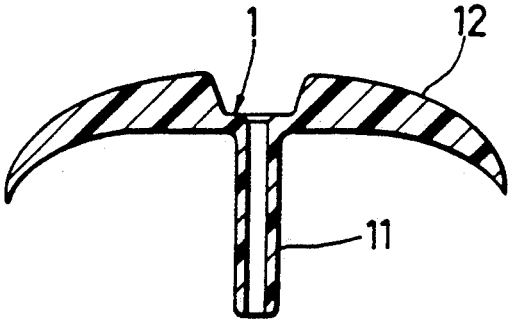
FIG. 4 PRIOR ART
FIG. 4 shows a sectional view of a portion taken along the line IV—IV as shown in FIG. 2.
Figure 5:
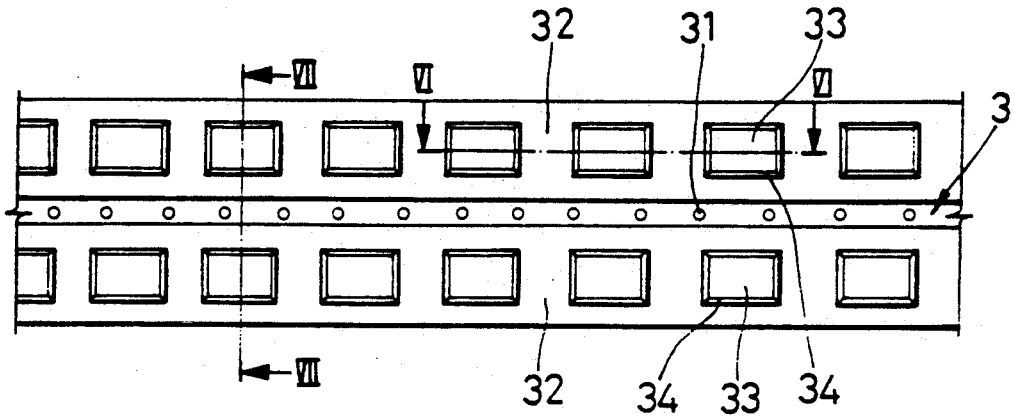
FIG. 5 shows a plan view of a first preferred embodiment of the present invention.
Figure 6:
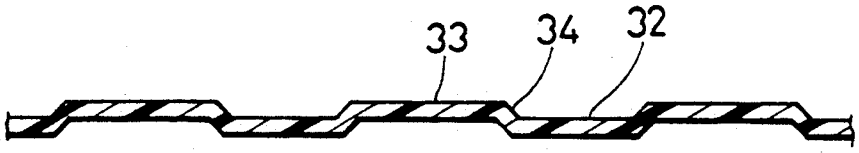
FIG. 6 shows a sectional view of a portion taken along the line VI—VI as shown in FIG. 5.
Figure 7:
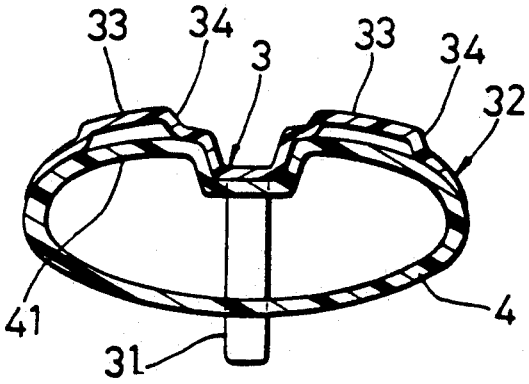
FIG. 7 is a sectional view of a portion taken along the line VII—VII as shown in FIG. 5, showing the protective casing mounted on the game racket frame.

Referring to FIGS. 5-7, a protective casing 3 of the first preferred embodiment of the present invention is shown to comprise a plurality of hollow tubes 31, which are spaced appropriately and are parallel to one another. The ends of the hollow tubes 31 situated on the same side of the hollow tubes 31 are attached to the main body of the protective casing 3. The main body of the protective casing 3 is provided at two sides thereof with two protective plates 32. The protective casing 3 is mounted on an outer wall 41 of a game racket frame 4 in a manner that the hollow tubes 31 are inserted respectively into string holes of the racket frame 4, and that the main body of the protective casing 3 and the protective plates 32 are attached fittingly to the outer wall 41. The main feature of the present invention is that each of the protective plates 32 is provided thereon with a plurality of floating plates 33, each of which has a thickness corresponding to the thickness of the protective plate 32, and each of which has an inner surface spaced at a predetermined distance from the outer wall 41 of the racket frame 4. In addition, the floating plate 33 is provided peripherally with a connecting plate 34 which is connected with the protective plate 32 in a manner that there is a height differential between the floating plate 33 and the protective plate 32.

Whenever the racket frame 4 hits a court ground or an object accidentally, the racket frame 4 is effectively protected by the protruded floating plate 33, which is located in such a way that there is a space between the floating plate 33 and the outer wall 41 of the racket frame 4, with the space serving as a displacement space of the floating plate 33 so as to bring about the cushion effect.

The weight of the protective casing 3 of the present invention is not increased, because the floating plate 32 has a thickness corresponding to the thickness of the protective plate 32.

Figure 8:
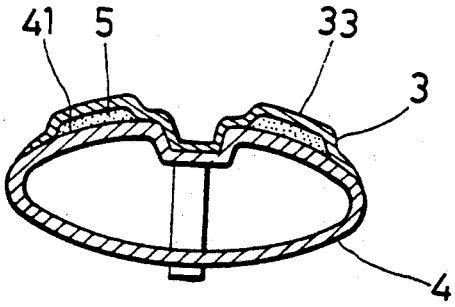
FIG. 8 is a sectional view of a second preferred embodiment of the present invention.
Figure 9:
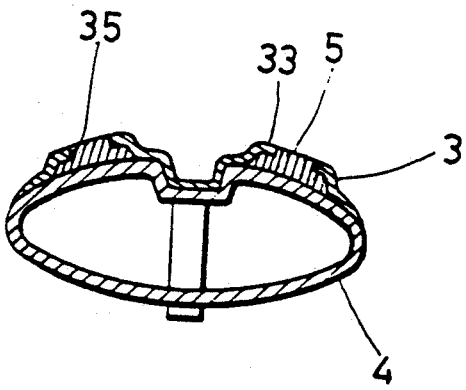
FIG. 9 is a sectional view of a third preferred embodiment of the present invention.

The second preferred embodiment of the present invention is shown in FIG. 8, in which the space between the floating plate 33 of the protective casing 3 and the outer wall 41 of the racket frame 4 is filled with a foam material or an elastic material 5. The third preferred embodiment of the present invention is shown in FIG. 9, in which the floating plate 33 is shown to comprise a hole 35, which permits the elastic material or the foam material 5 to emerge therefrom to form a protuberance.

The floating plate 33, or the hole 35 of the floating plate 33, or the elastic material 5 emerging from the hole 35 may be of a predetermined geometrical shape or word. The color of the elastic material or the foam material 5 may be selected as desired.

What is claimed is:

1. In a protective casing for a game racket of the type having a main body provided with a plurality of hollow tubes for insertion through string holes of a racket and a pair of protective plates extending outwardly from both sides of the main body for fitting engagement against an outer wall of a racket, the improvement comprising:

each protective plate being provided with a plurality of spaced floating plates and a peripheral connecting plate securing each floating plate to the protective plate and positioning the floating plate at a greater height than the protective plate so that an inner surface of each connecting plate is adapted to be spaced from an outer wall of a racket to define a displacement space forming a cushion to protect a racket from damage.

2. The protective casing of claim 1 wherein each floating plate has a thickness corresponding substantially to the thickness of the protective plate.

3. The protective casing of claim 1 wherein the displacement space of each floating plate is filled with an elastic material.

4. The protective casing of claim 3 wherein each floating plate includes a hole and a portion of the elastic material extends through the hole.

* * * * *